US012686534B2

(12) United States Patent
Knutson et al.

(10) Patent No.: US 12,686,534 B2
(45) **Date of Patent: *Jul. 21, 2026**

(54) CONTAINERS COVERS AND METHODS OF USING THE SAME

(71) Applicant: Inline Plastics Corp., Shelton, CT (US)

(72) Inventors: Herb Knutson, Waterbury, CT (US); Tanner Buxton, New Haven, CT (US); James Davis Smith, IV, Prospect, CT (US); David Demar, Edgewater, NJ (US); Keith Kristiansen, Stratford, CT (US); Roland Charriez, Plattekill, NY (US); Thomas Van Dyk, Ramsey, NJ (US)

(73) Assignee: Inline Plastics Corp., Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/653,053

(22) Filed: May 2, 2024

(65) Prior Publication Data

US 2024/0351753 A1 Oct. 24, 2024

Related U.S. Application Data

(63) Continuation of application No. 16/741,505, filed on Jan. 13, 2020, now Pat. No. 11,975,894.

(51) Int. Cl.
*B65D 43/16* (2006.01)
*B65D 55/02* (2006.01)

(52) U.S. Cl.
CPC ..... *B65D 43/162* (2013.01); *B65D 55/024* (2013.01); *B65D 2543/00203* (2013.01); *B65D 2543/00296* (2013.01); *B65D 2543/00462* (2013.01); *B65D 2543/00796* (2013.01)

(58) Field of Classification Search
CPC .. B65D 43/161; B65D 43/162; B65D 43/163; B65D 43/169
See application file for complete search history.

(56) References Cited

U.S. PATENT DOCUMENTS

| | | | | |
|---|---|---|---|---|
| 5,353,946 | A * | 10/1994 | Behrend | B65D 43/169 220/326 |
| 5,897,011 | A * | 4/1999 | Brilliant | B65D 43/162 220/4.23 |
| 8,939,312 | B1 * | 1/2015 | Buck | B65D 81/3205 220/709 |
| 2012/0031905 | A1 * | 2/2012 | Perez | B65D 81/245 53/471 |

* cited by examiner

*Primary Examiner* — Jeffrey R Allen
(74) *Attorney, Agent, or Firm* — McCarter & English, LLP

(57) ABSTRACT

A cover for a container that includes a lid portion and a collar element. The lid portion having a main body section surrounded by a peripheral sealing shoulder. The collar element having a peripheral collar sealing shoulder that includes a collar groove and wherein the lid portion is connected to the collar portion through a hinge element. The lid portion, collar element and hinge portion are formed as a unitary structure and the lid portion articulates from an open positon in which it is spaced apart from the collar element to a closed position wherein the peripheral bead sealing shoulder of the lid portion engages with the peripheral collar sealing shoulder of the collar element.

13 Claims, 7 Drawing Sheets

Container System

CONTAINERS COVERS AND METHODS OF USING THE SAME

CROSS REFERENCE TO RELATED APPLICATIONS

This application claims priority to and is a continuation of U.S. patent application Ser. No. 16/741,505, filed on Jan. 13, 2020 and entitled "Container Covers and Methods of Using the Same", which will issue as U.S. Pat. No. 11,975,894 on May 7, 2024, the disclosure of which is incorporated by reference in its entirety.

BACKGROUND OF THE INVENTION

1. Field of the Invention

The subject disclosure relates to covers for containers and methods of using the same, and more particularly to, covers that are adapted and configured to allow the cover to be combined with bases of various sizes (e.g., volumes, heights) and/or bases made from a variety of materials to form a container. The container formed can be reclosable and/or securely sealed and/or tamper-resistant.

2. Background of the Related Art

Numerous containers have been developed for packaging goods. The present containers for packaging goods are of fixed volume and their volume is not customizable by the user after purchase. Specifically, the prior containers are directed towards standardization of sizes and require customers to purchase, store and track an inventory of multiple different sizes which is problematic, especially when the demand for various sizes or volumes varies. This problem of standardized sizes is particularly exasperated when a container is used for packaging different volumes/weights of a good or when the size of the goods being packaged varies.

Moreover, the present containers are often made completely out of plastic and are not designed to allow mixing and matching of different materials to leverage the properties of the different materials. For example, an emerging demographics of consumers who are environmentally conscious and avoid containers made entirely out of plastic, especially when the containers are used for single use before disposal. Specifically, prior containers that are targeted towards the emerging demographics of environmentally conscious customers are made entirely of biodegradable materials such as cardboard or paper which are not as structurally durable as plastic, are susceptible to breakage, are at best translucent, are difficult to seal securely and are often less convenient. This problem is particularly exasperated when containers are used for storing goods that must be secure and sealed. For example, containers made out of materials that do not have the strong carbon chains present in plastics lose their structural integrity when used for goods that have a liquid content, when subject to stress around the corners or near the closures and often fail prematurely even in single use situations. Often the closures of the prior containers are not reclosable.

Based on the foregoing, a need exists for containers, especially containers that are customizable by the user to increase or decrease the volume of the container, that are capable of being securely sealed, that allow mixing and matching of different materials to leverage the properties of different materials such as thermal conductivity, cost, durability and environmental impact of waste. The aforementioned inefficiencies and opportunities for improvement are addressed and/or overcome by the assemblies, systems, and methods of the present disclosure.

SUMMARY OF THE INVENTION

The present disclosure is directed to a cover that is adapted and configured to allow the cover to be combined with bases of various sizes and/or bases made from a variety of materials to form a customizable container. More specifically, disclosed is a cover adapted and configured to receive customizable bases with a variety of sizes, materials, to form a reclosable container.

In accordance with some embodiments, the cover can feature a reclosable closure. In accordance with some embodiments, the cover can include a secure seal to indicate whether the packaging was opened prior to sale.

It should be appreciated that the present invention can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

Figure 1:
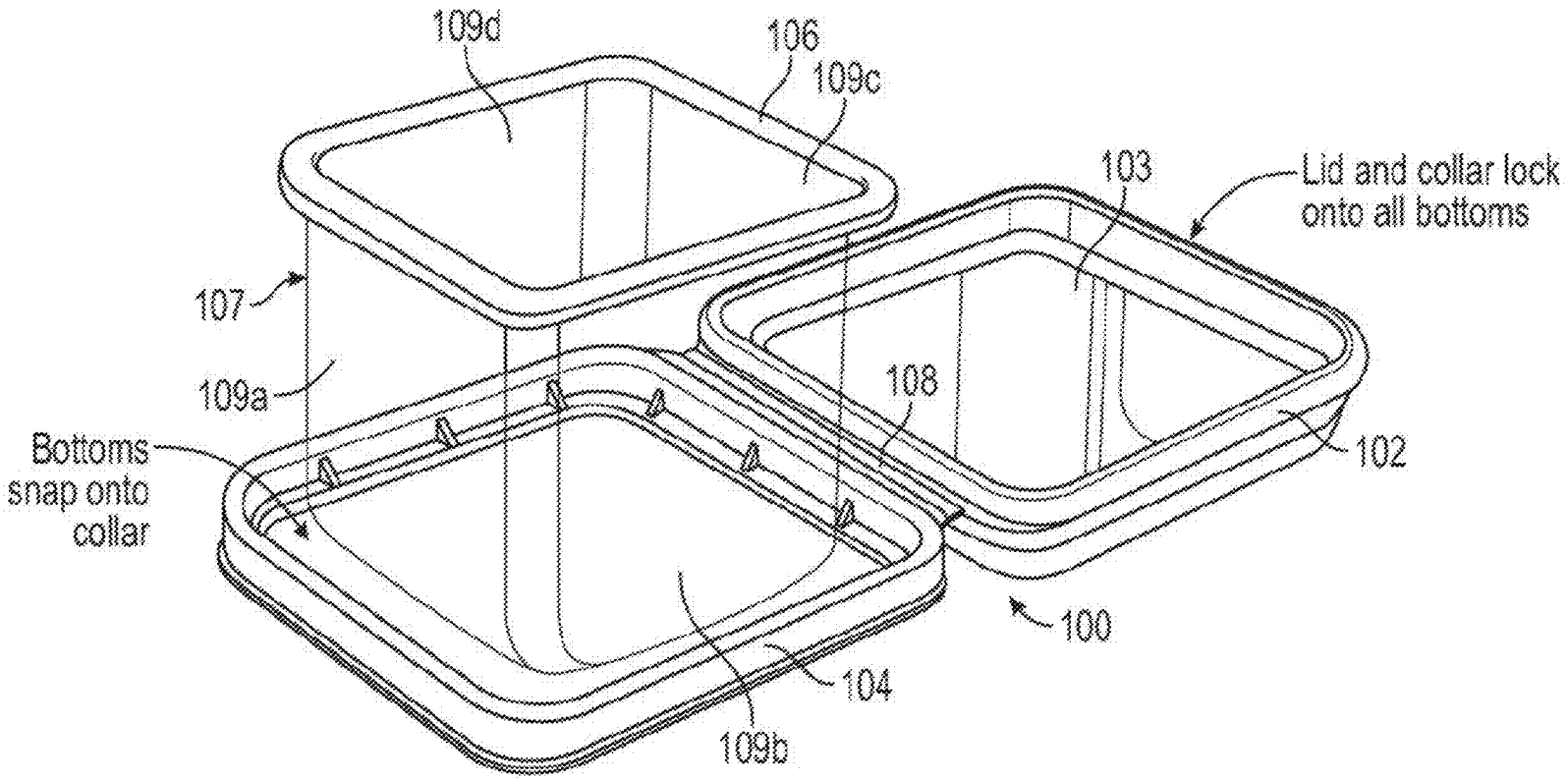
FIG. 1 is a perspective view of a cover adapted and configured to receive a base to form a container constructed in accordance with an embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF PREFERRED EMBODIMENTS

Disclosed herein are detailed descriptions of specific embodiments of covers for containers and methods of constructing the same. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. Moreover, the figures are not necessarily to scale and some features may be exaggerated or minimized to show details of particular components.

U.S. Pat. No. 9,630,756 describes containers for food products and the like that include a tamper-resistant and tamper-evident features the contents of this patent disclosure are hereby incorporated in this application in its entirety. As will be described in detail below, the covers disclosed herein can be constructed to include tamper-resistant and tamper-evident features. In certain instances those features can be similar to those described in U.S. Pat. No. 9,630,756. However, those skilled in the art will readily appreciate that the covers described herein can be formed without tamper-resistant or tamper-evident features or different mechanisms or constructions can be utilized than those described in U.S. Pat. No. 9,630,756.

Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

The present disclosure now will be described more fully, but not all embodiments of the disclosure are necessarily shown. In addition, many modifications may be made to adapt a particular situation or material to the teachings of the disclosure without departing from the essential scope thereof.

Referring now to FIGS. 1-4 which disclose a cover 100 constructed in accordance with an embodiment of the present invention, which is adapted and configured to receive a base 106 to form a container. In the disclosed embodiment, the cover 100 includes a lid portion 102 having a main body section 103 surrounded by a peripheral lid sealing shoulder 320 (shown and described in FIGS. 3H and 4H). The cover also includes a collar element 104 having a peripheral collar sealing shoulder 300 (shown and described in FIGS. 3G, 3H, 4G and 4H). The lid portion 102, the collar element 104 and a hinge portion 108 are formed as a unitary structure. The lid portion 102 articulates about the hinge portion 108 from an open position in which it is spaced apart from the collar element 104 to a closed position wherein the peripheral lid sealing shoulder 320 engages with a peripheral collar sealing shoulder 300 of the collar element 104.

In an example, the base 106 having a main body section 107 with side walls 109*a-d* and a bottom wall 111 forming an enclosed storage space, the main body section 107 surrounded by a peripheral base sealing shoulder 400 and is configured to slide into the collar element 104 and engage with the peripheral collar sealing shoulder 300 of the collar 104 to form a container. The collar peripheral sealing shoulder 300 and the peripheral lid sealing shoulder 320 can lock the peripheral base sealing shoulder 400 to create a sealed container in the closed position. In an embodiment, the peripheral base scaling shoulder 400 snaps (e.g., snap fit) onto the collar peripheral sealing shoulder 300 when the cover 100 is in an open position to form the bottom of the container. When the collar peripheral sealing shoulder 300 snap fits with the peripheral base sealing shoulder 400, the base 106 can remain engaged with the collar 104 when the cover 100 is the open position. Those skilled in the art will readily appreciate that various techniques can be used for securing the base 106 to the collar element 104 without departing from the scope of the present invention.

In another embodiment, the collar peripheral sealing shoulder 300 frictionally engages (e.g., press fit) with the peripheral base sealing shoulder 400 when inserted into the collar 104 and the base 106 is locked into place when the lid 102 is closed and the peripheral base sealing shoulder 400 is sandwiched between the peripheral lid sealing shoulder 320 and the peripheral collar sealing shoulder 300. When the peripheral collar sealing shoulder 300 is frictionally engaged the base 106 can be disengaged from the collar 104 when the cover 100 is in an open position.

In an embodiment, the cover 100 can include a lid 102 portion having a main body configured in a variety of shapes, including but not limited to, rectangular, circular, oval or elliptical. In an embodiment the cover 100 can be configured with a lid portion 102 having different cross-sectional dimensions to allow storage of different products of different dimensions/sizes.

In an embodiment, the hinge 108 can include tamper-resistant and tamper-evident features. The hinge portion 108 can include a tamper-evident frangible section or pull strip, which, upon its removal, severs the integral connection between lid portion 102 and the collar element 104. In accordance with the present invention, collar element 104 portion and lid portion 102 can include structural features that facilitate the formation of a non-permanent engagement between cover 100 to base 106 portion as described with reference to FIGS. 3H, 3G, 4H and 4G.

Figure 2:
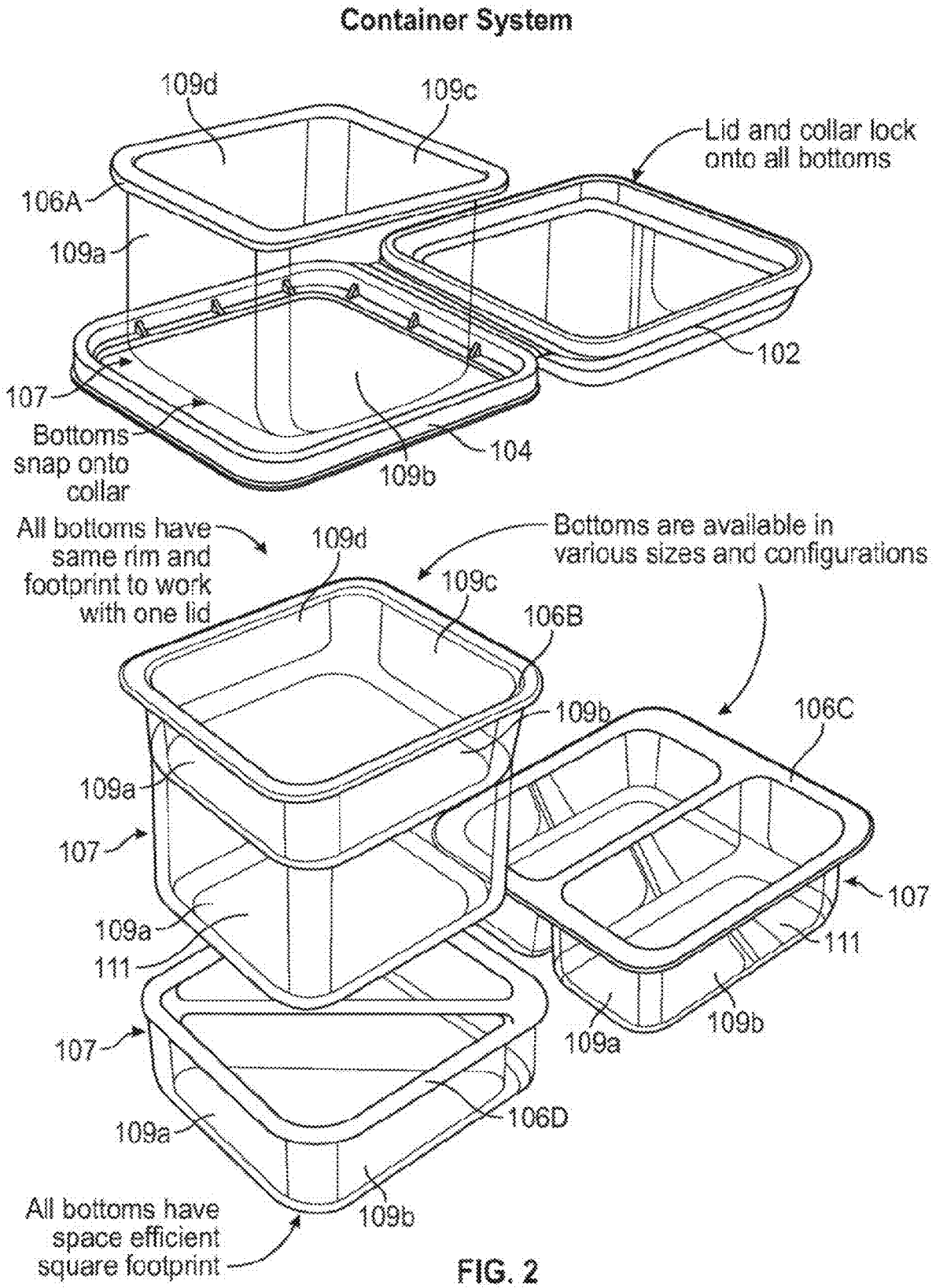
FIG. 2 is a perspective view of a cover adapted and configured to receive a variety of bases to form a container constructed in accordance with an embodiment of the present invention.

Referring now to FIG. 2 which depicts cover 100 configured and adapted to receive a variety of bases (e.g. bases 106A, 106B, 106C and 106D). In an embodiment, the cover 100 can receive a variety of bases with different volumes/sizes and/or made from different materials and the like. In an embodiment, the base 106 can be inserted into the collar 104 at the customer premises. An appropriate base (e.g., bases 106A thorough 106D can be chosen by the customer from a selection of bases. In an embodiment, the variety of bases (106A through 106D) can have a peripheral base scaling shoulder with the same footprint configured to engage with the peripheral collar scaling shoulder of the collar 104 that allow the same cover 100 to be used with a variety of bases 106A-106D without modification. In an embodiment, the variety of bases (106A through 106D) can have the same footprint to allow efficient stacking of containers with different sizes and dimensions of the bases during storage and transportation. For example, the variety of bases (106A thorough 106D) have a square footprint that maximizes the utilization of storage space to accommodate a wide selection of base during storage and transportation.

In an embodiment, the wide variety of bases (106A through 106D) can include a different internal configuration, different volumes and/or different sizes. For example, the base 106C and 106 D can include one or more internal walls within the side walls to create one or more compartments in conjunction with the bottom wall. The base 106C can include an internal wall that divides the space enclosed between the side walls and the bottom wall into two compartments. The base 106D can include an internal wall that diagonally runs from one edge of the container to the other edge dividing the space enclosed between the side walls and the bottom wall to form two triangular compartments. In an embodiment, the base (e.g., 106B) can include one or more compartments vertically spaced and interlocking with each other vertically to create two vertical compartments.

In an embodiment, the variety of bases (106A through 106D) can be made from biodegradable materials such as paperboard, recyclable materials such as aluminum foil, structurally rigid materials such as plastics or the like. The variety of bases can allow the consumer to select an appropriate base for use with the same cover based on the intended use, cost of materials, the property of the materials and the like.

In some embodiments, the thermal properties of the material of the base such as insulation of the contents of the container can determine the appropriate base material. In some embodiments, the hydrophilic or hydrophobic properties of the base can influence selection of the base for a specific application. For example, an aluminum foil base is with low emissivity and high reflectivity can be used for hot food. Similarly, a paperboard base with or without a plastic coating can be used for packaging moist food or dry food respectively. In another example, the consumer can choose the base 106 based on the cost of materials depending on the use. In an embodiment, disposable containers for packaging, distributing, displaying or otherwise housing consumer items, especially perishable foods, customers like recloseable containers.

In an embodiment, the base 106 with or without the collar 104 can be sealed using a film seal. For example, the base 106 with or without the collar 104 can be covered with a shrink tubing and heat sealed to seal the contents of the base 106. In another example, the base 106 with or without the collar 104 can be covered with a film and vacuum sealed to seal the contents of the base 106.

Figure 3A:
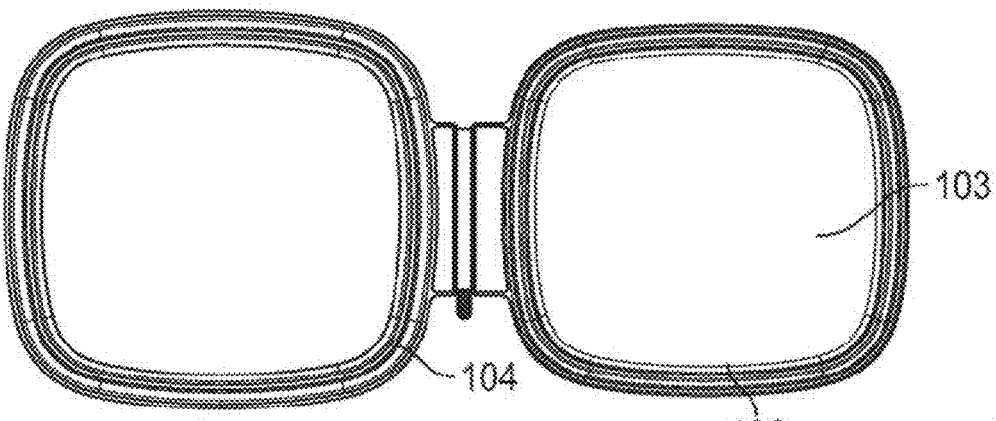
FIG. 3A depicts a top plan view of a cover adapted and configured to receive a variety of bases to form a container with a lid and collar in the open position and constructed in accordance with an embodiment of the present invention.
Figure 3D:
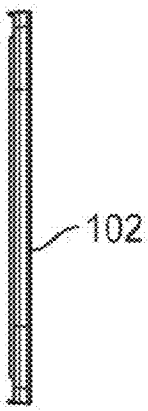
FIG. 3D depicts a right side view of the cover of FIG. 3A.
Figure 3B:
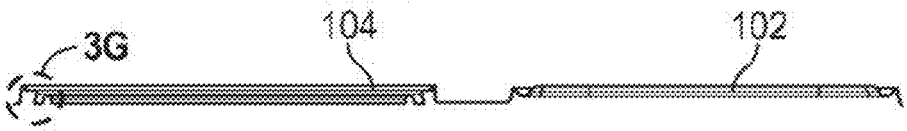
FIG. 3B depicts a front view in elevation of the cover of FIG. 3A.
Figure 3C:
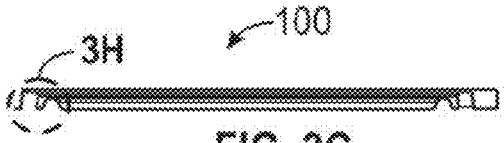
FIG. 3C depicts a front view in elevation of the cover of FIG. 3A with the lid and collar in the closed position without the base inserted.
Figure 3E:
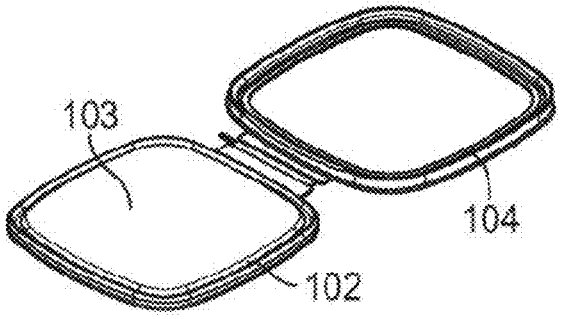
FIG. 3E depicts a perspective view taken from above of the cover of FIG. 3A shown in the open configuration.
Figure 3F:
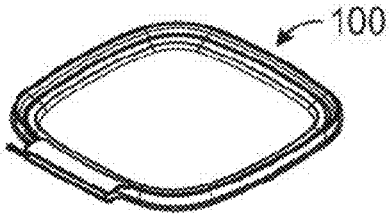
FIG. 3F depicts a perspective view taken from above of the cover of FIG. 3A shown in the closed configuration.
Figure 4A:
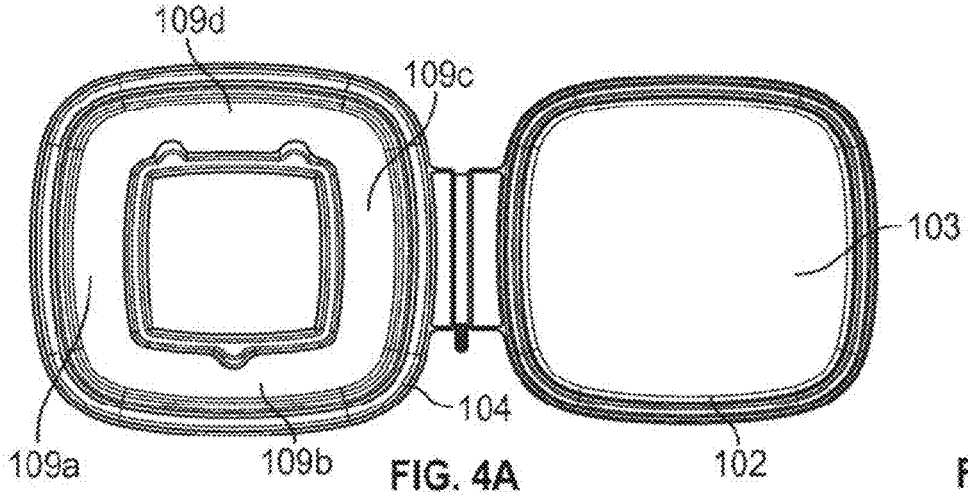
FIG. 4A depicts a top plan view of a cover as shown in FIG. 3A with a base inserted to form a container with the lid and collar open and constructed in accordance with an embodiment of the present invention.
Figure 4D:
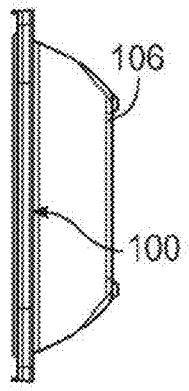
FIG. 4D depicts a right side view of a cover as shown in FIG. 3D with a base inserted to form a container with the lid and collar open and constructed in accordance with an embodiment of the present invention.
Figure 4B:
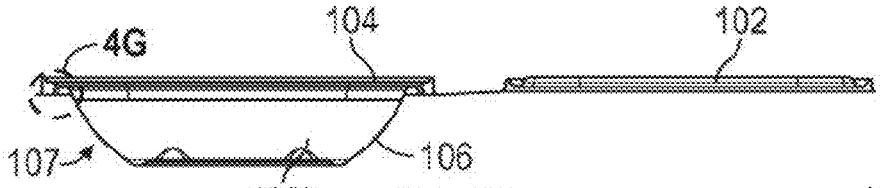
FIG. 4B depicts a front view in elevation of a cover as shown in FIG. 3B with a base inserted to form a container with the lid and collar open and constructed in accordance with an embodiment of the present invention.
Figure 4C:
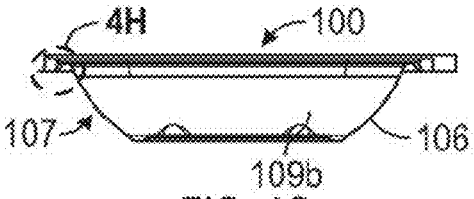
FIG. 4C depicts a front view in elevation of a cover as shown in FIG. 3C with a base inserted to form a container with the lid and collar closed without the base inserted constructed in accordance with an embodiment of the present invention.
Figure 4E:
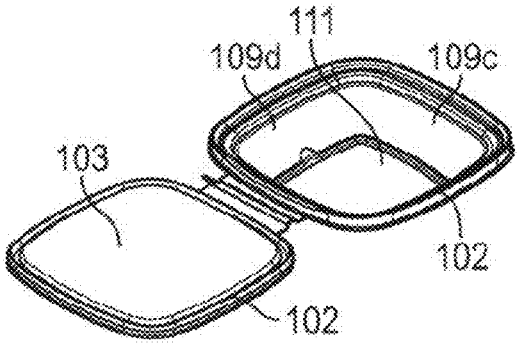
FIG. 4E depicts a perspective taken from above of a cover as shown in FIG. 3E with a base inserted to form a container with the lid and collar open and constructed in accordance with an embodiment of the present invention.
Figure 4F:
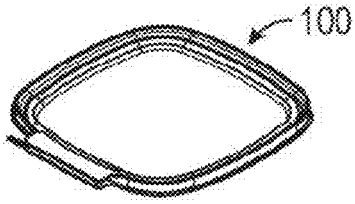
FIG. 4F depicts a perspective of a cover as shown in FIG. 4B with a base inserted to form a container with the lid and collar closed constructed in accordance with an embodiment of the present invention.

FIGS. 3A, 3B and 3D depicts a top plan view, a front view in elevation and the right side view respectively of the cover, showing the cover 100 in an open position configured and adapted to receive the base 106 (not shown in figure). FIGS. 4A, 4B and 4D depicts a top plan view, a front view in elevation and the right side view respectively of the cover, showing the cover 100 with the base 106 forming a container. FIGS. 3C and 4C depicts a front view in elevation of the cover with the cover 100 in a closed position with and without the base 106. FIGS. 3E and 4E depicts a perspective view of the cover including the cover 100 in the open position with and without the base 106. FIGS. 3F and 4F depicts a perspective view of the collar including the cover 100 in the closed position with and without the base 106. In an embodiment, the cover 100 with the base 106 can from a reclosable container.

Figure 3G:
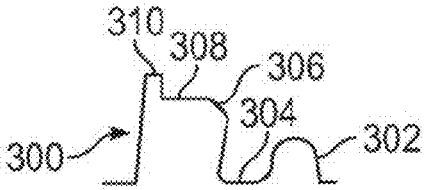
FIG. 3G depicts an enlarged cross-sectional view of a peripheral collar sealing shoulder of the collar shown in FIGS. 3A, 3B, 3D and 3E with the lid and collar in an open position configured to receive and engage a peripheral base sealing shoulder of the base in accordance with an embodiment of the present invention.
Figure 3H:
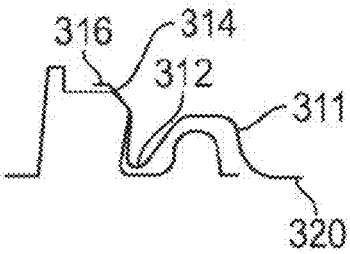
FIG. 3H depicts an enlarged cross-sectional view of a peripheral collar sealing shoulder of the collar shown in FIGS. 3A, 3B, 3D and 3E with the lid and collar in a closed position configured to receive and engage a peripheral base sealing shoulder of the base in accordance with an embodiment of the present invention.
Figure 4G:
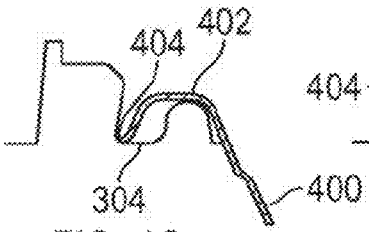
FIG. 4G depicts an enlarged cross-sectional view of the peripheral collar sealing shoulder of the collar shown in FIGS. 4A, 4B, 4D and 4E with the lid and the collar in an open position with a base profile of the base resting on the collar.
Figure 4H:
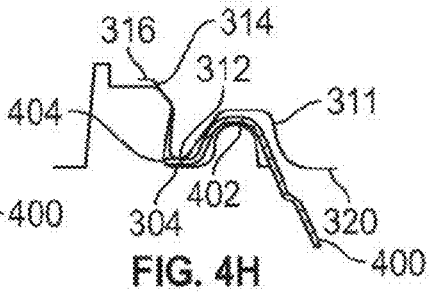
FIG. 4H depicts an enlarged cross-sectional view of the peripheral collar sealing shoulder of the collar shown in FIGS. 4A, 4B, 4D and 4E with the lid and the collar in an closed position with a base profile of the base resting on the collar and the base profile of the lid securing the base to form a container.

FIG. 3G depicts an enlarged cross-sectional view of a peripheral collar sealing shoulder 300 of the collar 104 shown in FIGS. 3A, 3B, 3D and 3E with cover 100 in the open position configured to receive and engage the peripheral base sealing shoulder 400 (shown and described in FIGS. 4G and 4H). The peripheral collar sealing shoulder 300 can include along the periphery or circumference, an upwardly projecting collar tongue 302, a downwardly extending collar groove 304, a collar slant 306 to arrest a corresponding lid slant 314, a collar flat 308 and a collar bead 310 to enclose a space around the collar. The peripheral collar sealing shoulder 300 is configured to engage corresponding circumferential features on the shoulders of the base 106 and the lid 102. FIG. 3H depicts an enlarged cross-sectional view of the peripheral collar scaling shoulder 300 engaging with the peripheral lid sealing shoulder 320 of the lid 102. The peripheral lid sealing shoulder 320 can include along the circumference a upwardly extending lid groove 311, a downward projecting lid tongue 312, a lid slant 314 that engages with a corresponding collar slant 306 and a lid flange tip 316 around the shoulder of the collar forming a profile configured to engage corresponding circumferential features on the shoulders of the collar 104 and the lip 102. The peripheral collar sealing shoulder 300 is configured to engage with the peripheral lid sealing shoulder 320 of the cover 100 when the lid 102 and the collar 104 are closed without the base 106 inserted in the cover 100. The lid slant 314 abuts the collar slant 306 circumferentially around the shoulder of the lid 102 and the collar 104 to form a seal when the lid 102 and the collar 104 are in the closed position with or without the base 106 inserted in the cover 100. The lid tongue 312 rests in the collar groove 304 circumferentially around the shoulder of the lid 102 and collar 104 when the cover 100 is in the closed position. Similarly, the lid groove 311 and the collar tongue 302 enclose a space circumferentially around the shoulder of the lid 102 and collar 102 to accommodate the peripheral base sealing shoulder 400 (shown and described in FIGS. 4F and 4G), when the lid 102 and the collar 104 are in the closed position. The collar bead 310 is configured and dimensioned to render the lid flange tip 316 relatively inaccessible when the lid 102 and the collar 104 are in the closed position thereby providing a tamper-resistant container. In addition, the hinge 108 preferably includes a frangible portion, which upon severing, facilitates removal of the cover portion from the base portion.

FIG. 4G depicts an enlarged cross-sectional view of the peripheral collar sealing shoulder 300 of the collar 104 shown in FIGS. 4A, 4B, 4D and 4E the lid 102 and the collar 104 in an open position with the peripheral base sealing shoulder 400 of the base 106 resting on the collar 104. The peripheral base sealing shoulder 400 includes a rim groove 402 and a downward projecting rim tip 404. The rim groove 402 engages with the collar tongue 302 circumferentially around the shoulder of the base 106 and the collar 104 when the base 106 is inserted into the collar 104 and the base tip 404 can rest in the collar groove 304 circumferentially around the shoulder thereby forming the base of a container. The FIG. 4H depicts an enlarged cross-sectional view of the peripheral collar sealing shoulder 300 of the collar 104 shown in FIGS. 4A, 4B, 4D and 4E with the lid 102 and the collar 104 in the closed position with the peripheral base scaling shoulder 400 resting on the peripheral collar sealing shoulder 300 secured between the lid 102 and the collar 106 to form a container. The lid tongue 312 can circumferentially deform the base tip 404 against the base groove 304 to create a seal when the collar 104 and the lid 102 are in a closed position to form a sealed container. Additionally the lid tongue 312 can also engage circumferentially with the rim groove 402 as shown in FIG. 4H to seal the contents of the base 106 when the lid 102 and the collar 104 are closed to create a sealed container. The lid slant 314 rests on the collar slant 306 circumferentially to form a seal between the lid 102 and the collar 104 in the cover 100 when the lid 102 and the collar 104 closed to form a secure container.

Figure 5A:
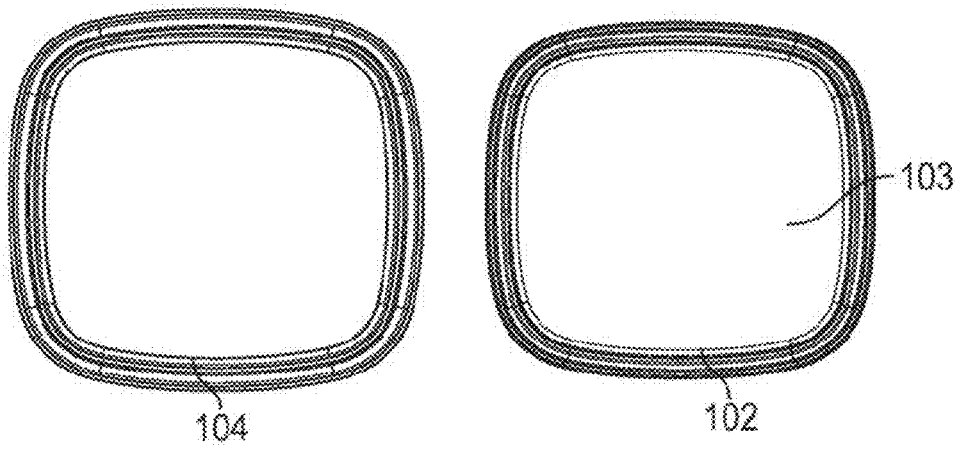
FIGS. 5A-5H and 6A-6H depicts a cover adapted and configured to receive a base to form a container constructed in accordance with an embodiment of the present invention.
Figure 5D:
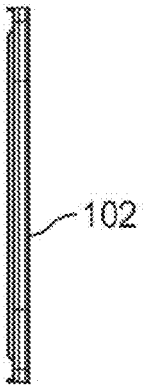
Figure 5B:
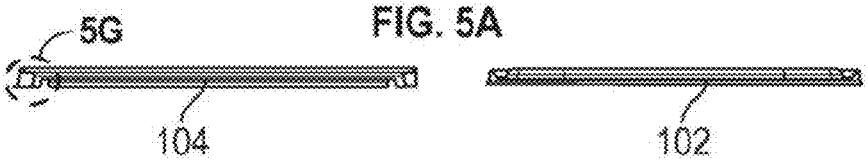
Figure 5C:
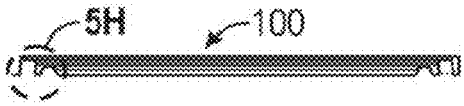
Figure 5E:
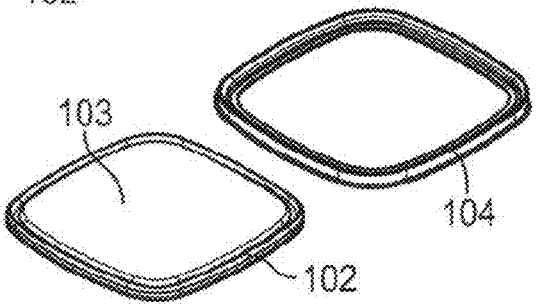
Figure 5F:
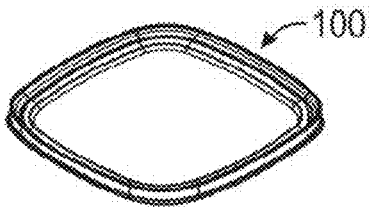
Figure 5G:
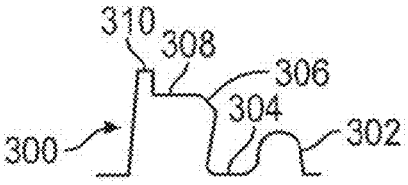
Figure 5H:
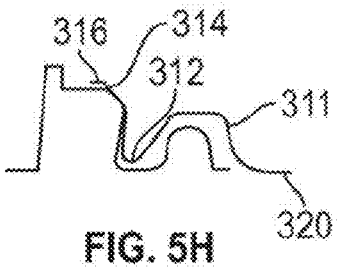
Figure 6A:
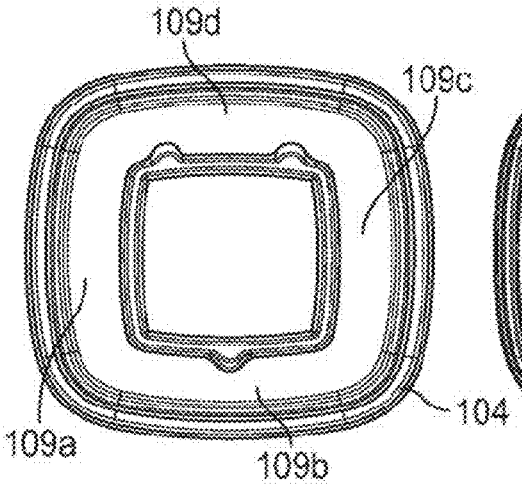
Figure 6D:
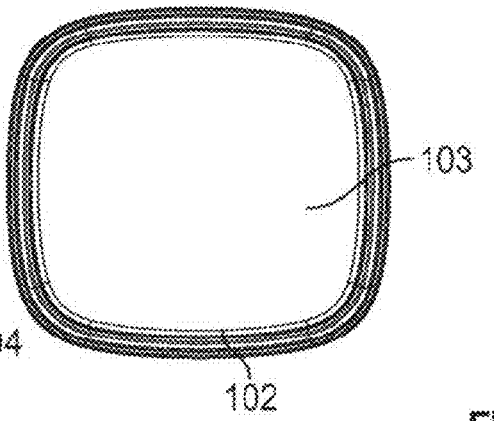
Figure 6D:
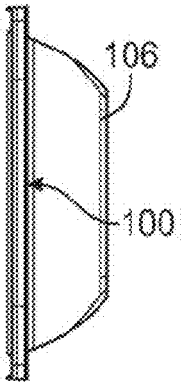
Figure 6B:
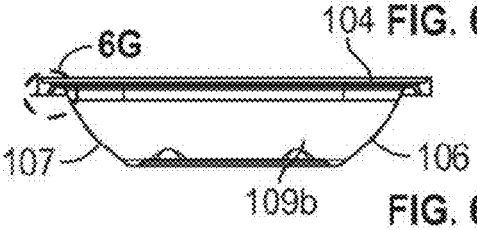
Figure 6C:
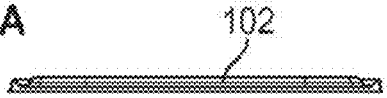
Figure 6C:
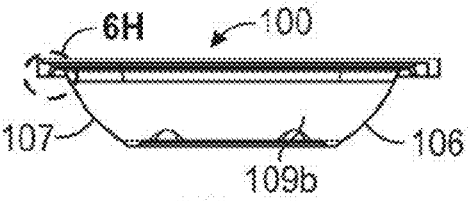
Figure 6E:
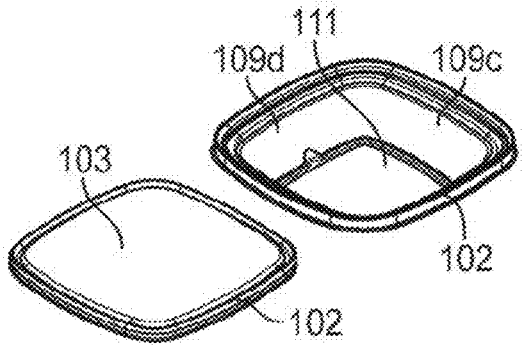
Figure 6F:
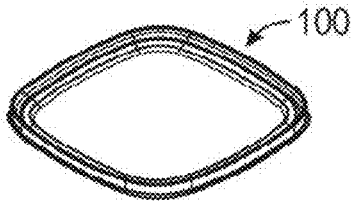
Figure 6G:
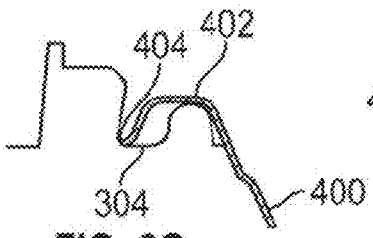
Figure 6H:
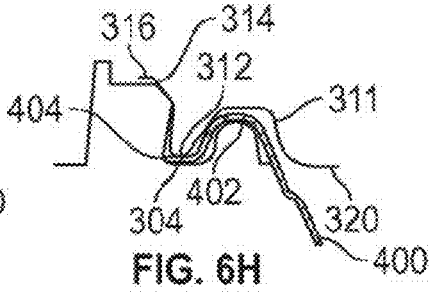

Referring now to FIGS. 5A-5H and FIGS. 6A-6H disclose a cover 100 including a lid portion 102 and a collar element 104 constructed in accordance with an embodiment of the present invention, which is adapted and configured to receive a base 106 to form a container. In the disclosed embodiment, the cover 100 includes a lid portion 102 having a main body section 107 surrounded by a peripheral lid sealing shoulder 320 (shown and described in FIGS. 5H and 6H). The cover also includes a collar element 104 having a peripheral collar sealing shoulder 300 (shown and described in FIGS. 5G, 5H, 6G and 6H) configured to receive and engage with the lid portion 102. The lid portion 102 and the collar element 104 are two separate and distinct from each other and are adapted to engage with each other to form a closed position wherein the peripheral lid sealing shoulder 320 engages with a peripheral collar sealing shoulder 300 of the collar element 104 or can be disengaged in an open position. In some embodiments, the lid portion 102 and the collar element 104 can include tamper evident elements which when disengaged after they are initially engaged may allow detection of the lid portion 102 and the collar element 104 having been opened.

In an example, the base 106 having a main body section 107 with side walls 109*a-d* and a bottom wall 111 forming an enclosed storage space, the main body section 107 surrounded by a peripheral base sealing shoulder 400 and is configured to slide into the collar element 104 and engage with the peripheral collar sealing shoulder 300 of the collar 104 to form a container. The peripheral collar sealing shoulder 300 and the peripheral lid sealing shoulder 320 can lock the peripheral base sealing shoulder 400 to create a sealed container in the closed position. Those skilled in the art will readily appreciate that various techniques can be used for securing the base 106 to the collar element 104 without departing from the scope of the present invention.

In an embodiment the base 106 can be formed from a non-plastic material such as paperboard and the lid portion 102 and the collar element 104 can be formed of a plastic material. The peripheral collar sealing shoulder 300 and the peripheral lid sealing shoulder 320 formed out of plastic can lock the peripheral base sealing shoulder 400 formed out of paperboard to create a sealed container in the closed position.

Figure 7:
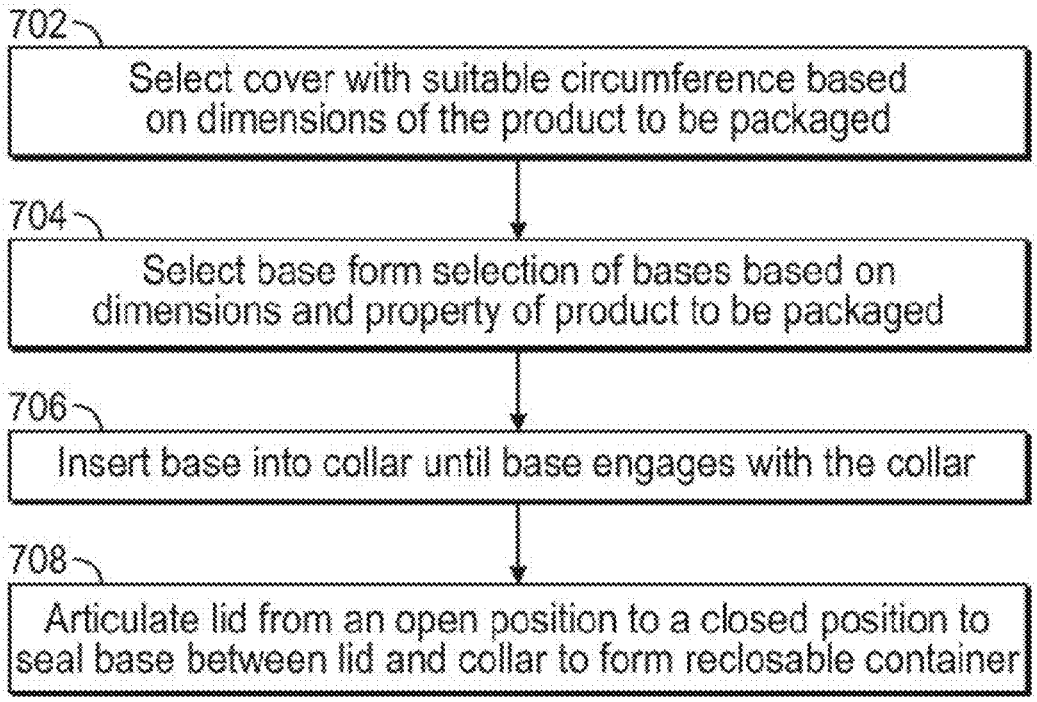
FIG. 7 depicts a method of assembling a container from the cover and a variety of bases constructed in accordance with an embodiment of the invention.

Referring to FIG. 7 a method of assembling a container from the cover 100 and a base selected from the variety of bases (106A-106D) is as follows.

In step 702, a cover 100 of a suitable circumference can be chosen from a selection of lid-collar assemblies based on the dimensions of the product to be packaged. For example, the cover 100 circumference can be based on the maximum width and base of an object to allow the object to be inserted into the base of similar circumferential dimensions.

In step 704, a base 106 can be chosen from the selection of bases (e.g. 106A-106D) based on the dimensions and property of the product to be packaged. For example, as described above with reference to FIG. 2, a paperboard base can be chosen to minimize the cost of the packaging or when an environmentally friendly alternative is desirable. In another example, a plastic base can be selected when the product to be packaged is a liquid. In another example, a base such as the base 106C or 106D with multiple compartments can be chosen when packaging multiple products in the same container. In another example, the base 106 can be chosen based on the length of the product to be packaged. In another example, a base 106 with multiple compartments can be selected to package more than one product in the same container.

In step 706, the base 106 is inserted into the collar 104 until the base 106 engages with the collar 104. In an embodiment, the base 106 can snap onto the collar 104. In this instance the base 106 will remain engaged with the collar 104 irrespective of whether the lid 102 is open or closed. In another embodiment, can frictionally engage (press fit) with the base 106 when inserted into the collar 104. In this instance the base 106 can be removed from the collar 104 when the lid 102 is open.

In step 708, the lid 102 can be articulated from the open position to the closed position sealing the base 106 between the lid 102 and the collar 104 to form a container. In an embodiment, the container formed can be reclosable. In another embodiment, the container formed can include a tamper-evident strip to indicate whether the container was opened and closed after packaging.

It should be readily understood that a cover constructed in accordance with the present invention, which is preferably a plastic cover used for carrying products, can be manufactured in a variety of shapes and sizes, and can be formed from resins or plastic materials such as polyethylene, polypropylene, polyvinyl chloride or polyethylene terephthalate ("PETE"), as well as other suitable materials or combinations thereof. The forming process can also vary to include methods such as thermo-forming, injection molding or blow molding. The cover can be transparent or translucent, and may be colored in either instance. Also, vents can be provided in the cover to promote airflow there through, if appropriate based on the intended contents of the container. Preferably, cover 100 is formed from a roll of PETE subjected to a vacuum and pressure mold with plug assist.

Similarly, a base in accordance with the present invention, which is made of a wide variety of materials such as paperboard, aluminum foil, plastic and the like. In an example, the plastic base used for carrying products, can be manufactured in a variety of shapes and sizes, and can be formed from resins or plastic materials such as polyethylene, polypropylene, polyvinyl chloride or polyethylene terephthalate ("PETE"), as well as other suitable materials or combinations thereof. The forming process can also vary to include methods such as thermo-forming, injection molding or blow molding. The base can be transparent or translucent, and may be colored in either instance. Also, vents can be provided in the base to promote airflow there through, if appropriate based on the intended contents of the container. Preferably, base 106 is formed from a roll of PETE subjected to a vacuum and pressure mold with plug assist.

In other examples the paperboard or aluminum foil base can be manufactured in a variety of shapes and sizes. The base forming process can also vary to include methods such as surface sizing, machine glazing, calendaring, surface coating, surface finishing and/or press forming methods. The base can be surface coated to make the base either hydrophobic or hydrophilic and can be colored in either instance. Also, vents can be provided in the base to promote airflow there through, if appropriate based on the intended contents of the container.

Although the present disclosure has been described with reference to exemplary implementations, the present disclosure is not limited by or to such exemplary implementations. Rather, various modifications, refinements and/or alternative implementations may be adopted without departing from the spirit or scope of the present disclosure.

What is claimed is:

1. A container comprising:

a lid portion having a main body section surrounded by a peripheral lid sealing shoulder;

a collar element having a peripheral collar sealing shoulder that includes a sealing groove; and a base portion having a main body section enclosing a space between side walls and a bottom wall surrounded by a peripheral base sealing shoulder;

wherein when the lid portion is in a closed position the peripheral lid sealing shoulder of the lid portion engages with the peripheral collar sealing shoulder of the collar element and the peripheral collar sealing shoulder engages with the base sealing shoulder; and wherein the peripheral lid sealing shoulder secures the peripheral base sealing shoulder between the peripheral lid sealing shoulder and peripheral collar sealing shoulder forming a completed container.

2. The container of claim 1, wherein a hinge portion joins the lid portion to the collar element; wherein the lid portion, collar element and hinge element are formed as a unitary structure and the lid portion.

3. The container of claim 1, wherein the peripheral collar sealing shoulder engages with the base sealing shoulder using a snap fit mechanism to form a container.

4. The container of claim 1, wherein the peripheral collar sealing shoulder engages with the base sealing shoulder using a press fit mechanism and the peripheral lid sealing shoulder secures the peripheral base sealing shoulder against the peripheral collar sealing shoulder to create a seal.

5. The container of claim 4, wherein a base tip of the peripheral base sealing shoulder is deformed by a lid tongue of the peripheral lid sealing shoulder when the lid is closed to form a seal.

6. The container of claim 1, wherein the container formed includes a tamper evident element.

7. The container of claim 6, wherein the tamper evident element is a tamper evident hinge.

8. The container of claim 1, wherein the container formed is reclosable.

9. The container cover of claim 1, wherein the hinge is a severable.

10. The container of claim 1 wherein the base includes an internal wall to compartmentalize the space enclosed between the side walls and the bottom wall to form one or more compartments.

11. A method of assembling a container comprising:

selecting a cover based on the dimensions of a product being stored, the cover comprising a lid portion having a main body section surrounded by a peripheral cover sealing shoulder, selecting a collar element based on the lid portion, the collar element having a peripheral rim that includes a sealing groove;

selecting a base based on the dimensions and property of the product being stored, the base comparing a main body section enclosing a space between side walls and a bottom wall surrounded by a peripheral base sealing shoulder;

inserting the base into the collar until the peripheral collar sealing shoulder engages with the base peripheral sealing shoulder; and articulating the lid portion of the cover between an open position which is spaced apart from the collar portion to a closed position, wherein the peripheral lid sealing shoulder engages with the peripheral collar sealing shoulder of the collar portion and wherein the peripheral lid sealing shoulder secures the peripheral base sealing shoulder between the peripheral lid sealing shoulder and peripheral collar sealing shoulder to form a container.

12. The method of claim 11 wherein engaging the peripheral collar sealing shoulder with the peripheral base sealing shoulder comprises:

snapping the peripheral base sealing shoulder into the peripheral collar sealing shoulder using a snap fit mechanism.

13. The method of claim 11 wherein engaging the peripheral collar sealing shoulder with the peripheral base sealing shoulder comprises:

frictionally resting the peripheral base sealing shoulder into the peripheral collar sealing shoulder; and frictionally securing the peripheral base sealing shoulder between the peripheral collar sealing shoulder and the peripheral lid sealing shoulder when the cover is the closed position.

* * * * *